US009653203B2

(12) United States Patent
Yamauchi et al.

(10) Patent No.: US 9,653,203 B2
(45) Date of Patent: May 16, 2017

(54) MULTILAYER INDUCTOR

(71) Applicant: FDK CORPORATION, Tokyo (JP)

(72) Inventors: Kiyohisa Yamauchi, Tokyo (JP); Daisuke Matsubayashi, Tokyo (JP); Juji Kato, Tokyo (JP); Mikio Kitaoka, Tokyo (JP); Shigenori Suzuki, Tokyo (JP)

(73) Assignee: FDK CORPORATION, Tokyo (JP)

( * ) Notice: Subject to any disclaimer, the term of this patent is extended or adjusted under 35 U.S.C. 154(b) by 0 days.

(21) Appl. No.: 14/898,587

(22) PCT Filed: May 16, 2014

(86) PCT No.: PCT/JP2014/002577
§ 371 (c)(1),
(2) Date: Dec. 15, 2015

(87) PCT Pub. No.: WO2014/203447
PCT Pub. Date: Dec. 24, 2014

(65) Prior Publication Data

US 2016/0141089 A1 May 19, 2016

(30) Foreign Application Priority Data

Jun. 19, 2013 (JP) ..... 2013-128372

(51) Int. Cl.
*H01F 21/00* (2006.01)
*H01F 27/255* (2006.01)
(Continued)

(52) U.S. Cl.
CPC ..... *H01F 27/255* (2013.01); *H01F 17/0013* (2013.01); *H01F 17/0033* (2013.01);
(Continued)

(58) Field of Classification Search
CPC .. H01F 5/00; H01F 27/00–27/30; H01F 21/00
(Continued)

(56) References Cited

FOREIGN PATENT DOCUMENTS

| | | |
|---|---|---|
| JP | 2-81410 | 3/1990 |
| JP | 3-101106 | 4/1991 |

(Continued)

OTHER PUBLICATIONS

International Search Report issued Aug. 26, 2014 in corresponding International Application No. PCT/JP2014/002577 (with English translation).

*Primary Examiner* — Tuyen Nguyen
(74) *Attorney, Agent, or Firm* — Wenderoth, Lind & Ponack, L.L.P.

(57) ABSTRACT

A multilayer inductor providing improved DC superposition characteristics by a permanent magnet that emits a bias magnetic flux, and having a low-loss material as a magnetic body to improve converter conversion efficiency. The multilayer inductor has a plurality of laminated electrically insulating magnetic layers; and laminated conductive patterns, each of the conductive patterns being connected in sequence in the lamination direction forming a spiral coil inside the magnetic layer. An magnetized annular permanent magnet layer emits a magnetic flux whose direction is opposite that of a magnetic flux excited by the coil is between an outer peripheral edge of the inductor and an outer peripheral edge of the coil so as not to overlap an inner peripheral part of the magnet layer with the conductive patterns and so as to block a space between the conductive patterns and the magnet layer, in axial view of the coil.

5 Claims, 13 Drawing Sheets

(51) Int. Cl.
*H01F 17/00* (2006.01)
*H01F 27/245* (2006.01)
*H01F 27/28* (2006.01)

(52) U.S. Cl.
CPC ..... *H01F 21/00* (2013.01); *H01F 27/245* (2013.01); *H01F 27/2804* (2013.01); *H01F 2017/0066* (2013.01); *H01F 2027/2809* (2013.01)

(58) Field of Classification Search
USPC ..... 336/65, 83, 110, 200, 232
See application file for complete search history.

(56) References Cited

FOREIGN PATENT DOCUMENTS

| | | |
|---|---|---|
| JP | 2002-170715 | 6/2002 |
| JP | 2002-175917 | 6/2002 |
| JP | 2002-175927 | 6/2002 |
| JP | 2006-196591 | 7/2006 |

| | CLEARANCE WITH CONDUCTOR | MAGNET THICKNESS | CHIP INTERNAL CROSS-SECTION SCHEMATIC DIAGRAM (PERPENDICULAR TO LAMINATION DIRECTION) | DC SUPERPOSITION CHARACTERISTIC COMPARISON (SIMULATION) |
|---|---|---|---|---|
| ① | 0um | 60um |   |   |
| ② | 50um | 60um |   | |
| ③ | 50um | 60um |   | |

| | CLEARANCE WITH CONDUCTOR | MAGNET THICKNESS | INTERNAL CROSS-SECTION SCHEMATIC DIAGRAM | DC SUPERPOSITION CHARACTERISTIC COMPARISON |
|---|---|---|---|---|
| ④ | 0um | 120um |   |   |
| ⑤ | 50um | 120um |   | |
| ⑥ | 50um | 120um |   | |

| | AMOUNT OF OVERLAPPING WITH CONDUCTOR | MAGNET THICKNESS | INTERNAL CROSS-SECTION SCHEMATIC DIAGRAM | DC SUPERPOSITION CHARACTERISTIC COMPARISON |
|---|---|---|---|---|
| ① | 0um | 60um |   |   |
| ⑦ | 150um | 60um |   | |

| | AMOUNT OF OVERLAPPING WITH CONDUCTOR | MAGNET THICKNESS | INTERNAL CROSS-SECTION SCHEMATIC DIAGRAM | DC SUPERPOSITION CHARACTERISTIC COMPARISON |
|---|---|---|---|---|
| ④ | 0 | 120um |   |   |
| ⑧ | 150um | 120um |   | |

MULTILAYER INDUCTOR

TECHNICAL FIELD

The present invention relates to a suitable multilayer inductor used as an inductor for a DC-DC converter particularly requiring a high bias, or the like.

BACKGROUND ART

Recently, with a request for reduction in a size and reduction in a thickness of a power circuit component, a chip inductor having a laminate structure is developed and put into use as a transformer or a choke coil used in a power supply circuit such as a DC-DC converter.

In such a multilayer inductor, electrically insulating magnetic layers and conductive body patterns are alternately laminated, and the above conductive body patterns are connected in the lamination direction in sequence, so that a coil that spirally circulates while being superimposed in the lamination direction is formed in a magnetic body, and each of the both ends of the coil is drawn out on the outer surface of a laminated body chip through a draw-out conductor. Herein, a ferrite is used as the magnetic body, the magnetic layers and the conductive body patterns are formed to be laminated by using, for example, a screen printing method.

On the other hand, in a mobile market where the reduction in a size is recently requested, a current value which flows in an inductor increases in accordance with rise in the switching frequency of a power supply to be used, and improvement in processing performance of the power supply. In the above ferrite, a loss at a high frequency (several MHz to several dozens MHz) is generally less, and therefore a laminated chip inductor using a ferrite material is optimized for a mobile power supply that operates at a high switching frequency. Additionally, in the mobile market, since the chip shape is excellent in mounting performance or mass productivity, a large number of laminated chip inductors have been employed.

However, the above ferrite generally tends to be low in magnetic flux saturation density, and to be bad in DC superposition characteristics, and therefore it is becoming difficult to follow the electric current increase in the recent mobile market.

In order to solve this, a measure for improving the DC superposition characteristics in the above multilayer inductor by increasing the size of the above coil, and reducing the density of a magnetic flux that flows in the coil, or using a metal material unlikely to be saturated as a magnetic material itself is considered. However, when the above coil size is increased, increase in the whole of the multilayer inductor is caused, which is against the market request. Additionally, a chip inductor, in which the chip shape having excellent mounting performance is maintained, and in which a metal material unlikely to cause magnetic saturation is used as a magnetic body, appears in the market. However, the chip inductor has disadvantage that the metal material generally has a large loss at a high frequency compared to the ferrite, and that conversion efficiency is reduced in a conversion usage.

The magnetic body used for the above multilayer inductor is saturated by a magnetic flux excited from a current flowing in the coil in the operation of a power supply. Accordingly, when the saturation of the above magnetic body can be suppressed, it becomes possible to improve the DC superposition characteristics.

Therefore, in the following Patent Literatures 1 and 2, as illustrated in FIG. 15, there is proposed an inductance element, in which a permanent magnet 22 is disposed inside a coil 21 buried in a magnetic body 20, and a magnetic flux X excited from the coil 21 is offset by a bias magnetic flux Y, which is emitted from the permanent magnet 22, and the direction of which is opposite to the direction of the magnetic flux X, so that the saturation of the magnetic body is suppressed, and the DC superposition characteristics is improved.

However, as illustrated in this figure, in a case where the permanent magnet 22 is disposed inside the coil 21, a leakage magnetic flux Z which does not act as a bias magnetic flux is emitted around the permanent magnet 22 inside the magnetic body 20, in addition to the magnetic flux Y whose direction is opposite to the direction of the magnetic flux X emitted from the permanent magnet 22 and excited by the coil 21. Therefore, there is a problem that the bias magnetic flux Y from the permanent magnet 22 does not effectively work, and the DC superposition characteristics can hardly be improved as expected.

CITATION LIST

Patent Literature

[Patent Literature 1]
Japanese Patent Laid-Open No. 2002-170715
[Patent Literature 2]
Japanese Patent Laid-Open No. 3-101106

SUMMARY OF INVENTION

Technical Problem

The present invention has been made in view of the above circumstances, and an object of the present invention is to provide a multilayer inductor which can significantly improve DC superposition characteristics by a permanent magnet which generates a bias magnetic flux, and which can use a low-loss material as a magnetic material to also achieve the improvement of converter conversion efficiency.

Solution to Problem

In order to solve the problem, a multilayer inductor according to the invention recited in claim 1 includes: a plurality of electrically insulating magnetic layers that are laminated; and conductive patterns that are laminated, each of the conductive patterns being connected in sequence in the lamination direction to form a spirally circulating coil inside the magnetic layers, both ends of the coil being drawn out to an outer peripheral part, wherein an annular permanent magnet layer magnetized so as to emit a magnetic flux whose direction is opposite to a direction of a magnetic flux excited by the coil is disposed between an outer peripheral edge of the multilayer inductor and an outer peripheral edge of the coil so as not to overlap an inner peripheral part of the annular permanent magnet layer with the conductive patterns and so as to block a space between the conductive patterns and the annular permanent magnet layer, in axial view of the coil.

A multilayer inductor according to the invention recited in claim 2 has: a plurality of electrically insulating magnetic layers that are laminated; and conductive patterns that are laminated, each of the conductive patterns being connected in sequence in the lamination direction to form a spirally circulating coil inside the magnetic layers, both ends of the coil being drawn out to an outer peripheral part, wherein an annular permanent magnet layer magnetized so as to emit a magnetic flux whose direction is opposite to a direction of a magnetic flux excited by the coil is disposed over a whole surface of inside of the coil so as not to overlap an outer peripheral part of the annular permanent magnet layer with the conductive patterns and so as to block a space between the conductive patterns and the annular permanent magnet layer, in axial view of the coil.

According to the invention recited in claim 3, in the invention recited in claim 1 or 2, in the axial view, a clearance is formed between the permanent magnet layer and the conductive pattern, and the clearance is blocked by an annular electrically insulating nonmagnetic pattern interposed between the permanent magnet layer and the conductive pattern.

Furthermore, according to the invention recited in claim 4, in the invention recited in any of claims 1 to 3, the magnetic layer and the permanent magnet layer, or the magnetic layer, the permanent magnet layer, and the nonmagnetic pattern each are formed of a material which is capable of being collectively burned at a temperature of 940° C. or less.

According to the invention recited in claim 4, in the invention recited in claim 5, a Ni—Zn ferrite based material is used as the magnetic layer, a Zn ferrite based material is used as the nonmagnetic pattern, and a low-temperature sintered magnet material obtained by adding $Bi_2O_3$ and $SiO_2$ to Ba ferrite powder or Sr ferrite powder is used as the permanent magnet layer.

Advantageous Effects of Invention

In the invention recited in any of claims 1 to 5, the permanent magnet layer is disposed over the whole surface of the outside of the coil or the whole surface of the inside of the coil in axial view, and therefore a leakage magnetic flux Z which does not works as a bias magnetic flux Y and has an opposite direction, like a permanent magnet illustrated in FIG. 15, is not generated. As a result, the permanent magnet layer can significantly improve DC superposition characteristics. Additionally, a low-loss material relatively easily saturated can be used as the magnetic body (magnetic layer), and it is possible to achieve the improvement of converter conversion efficiency.

Furthermore, like the invention recited in claim 4, manufacture can be facilitated by using the material which is capable of being collectively baked at a temperature of 940° C. or less as the magnetic layer, the permanent magnet layer and the nonmagnetic pattern, sintering a laminated body at a low temperature of 940° C. or less to be integrated, and thereafter magnetizing the permanent magnet layer.

More specifically, like the invention recited in claim 5, it is suitable that the Ni—Zn ferrite based material is used as the magnetic layer, the Zn ferrite based material is used as the nonmagnetic pattern, the low-temperature sintered magnet material obtained by adding $Bi_2O_3$ and $SiO_2$ to the Ba ferrite powder or the Sr ferrite powder is used as the permanent magnet layer.

DESCRIPTION OF EMBODIMENTS

First Embodiment

Figure 1:
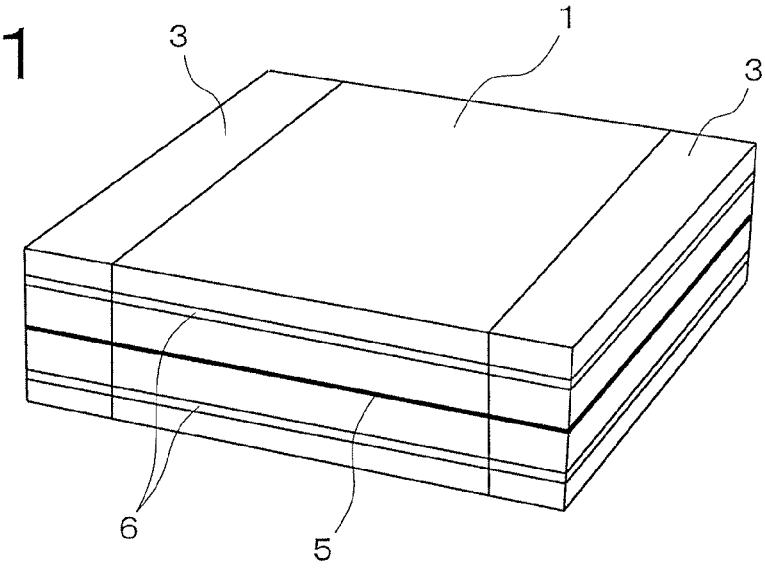
FIG. 1 is a whole perspective view illustrating a first embodiment of a multilayer inductor of the present invention.
Figure 2:
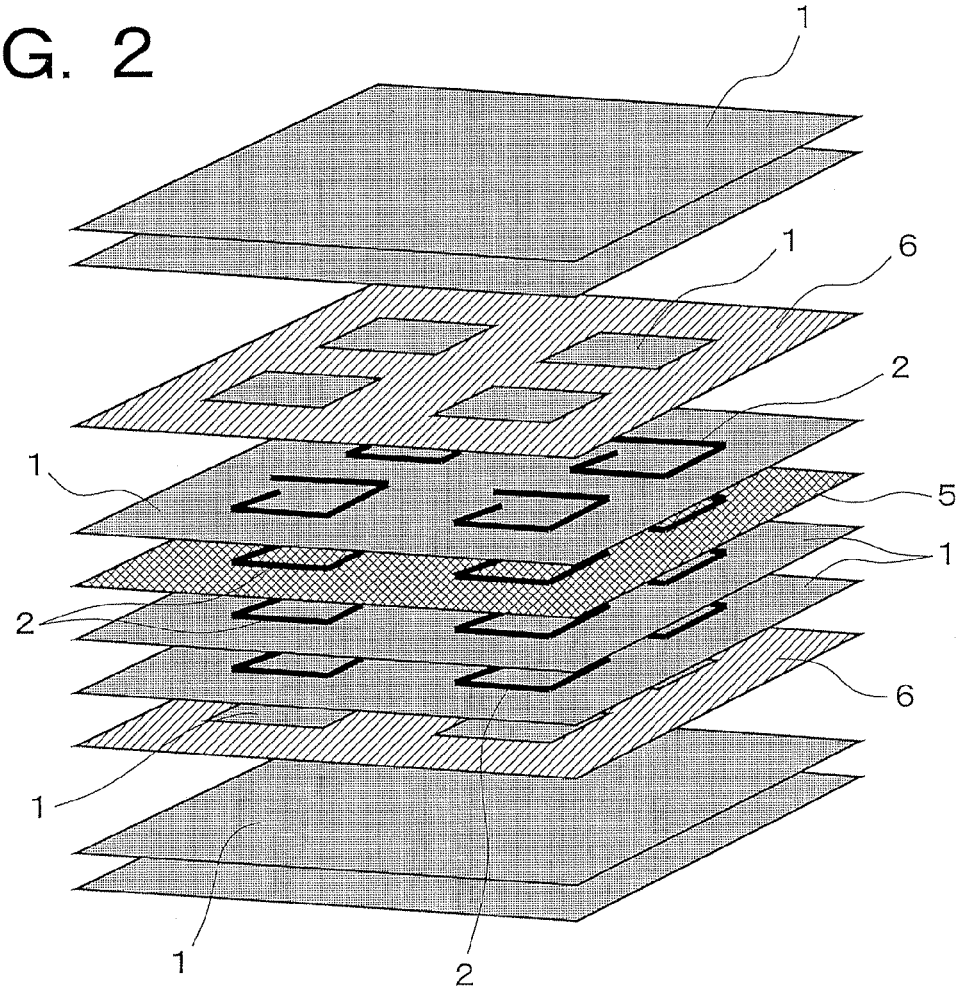
FIG. 2 is an exploded perspective view illustrating a laminated body for manufacturing the multilayer inductor of FIG. 1.
Figure 3A:
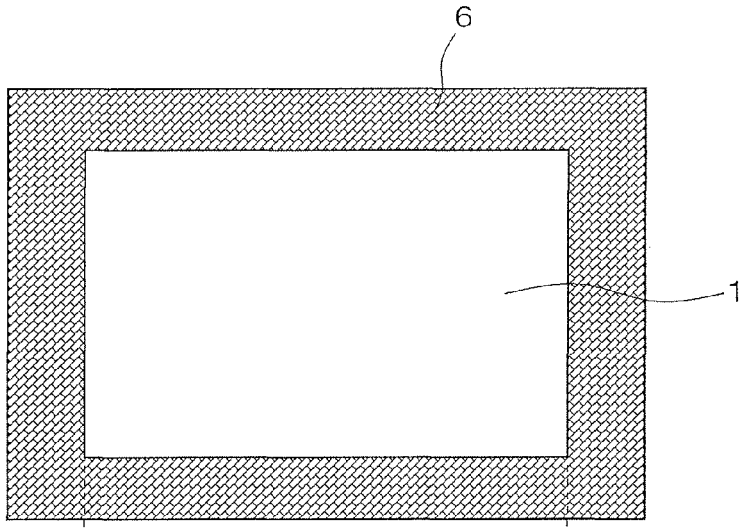
FIG. 3 illustrates the multilayer inductor of FIG. 1, in which (a) is a plane sectional view, and (b) is a longitudinal sectional view.
Figure 3B:
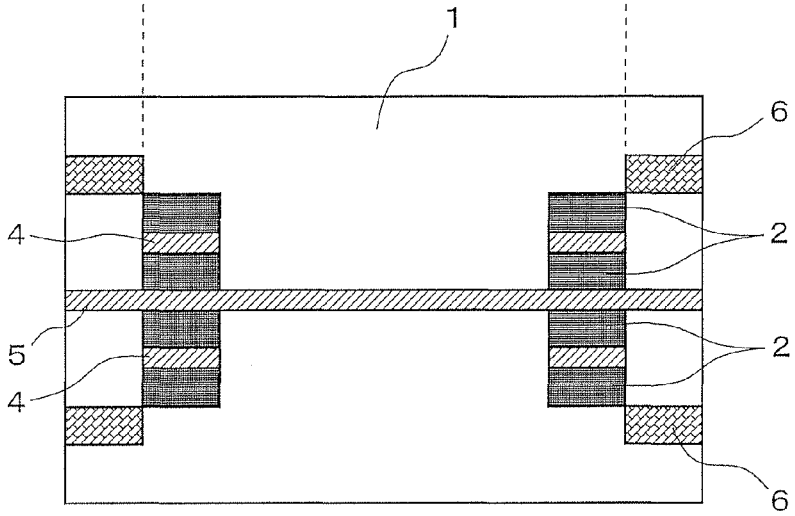
Figure 4:
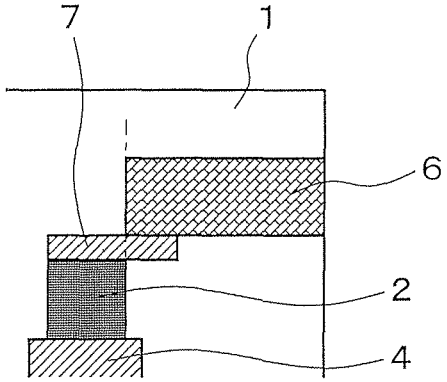
FIG. 4 is a longitudinal sectional view of a principal part illustrating a first modification of the first embodiment.
Figure 5:
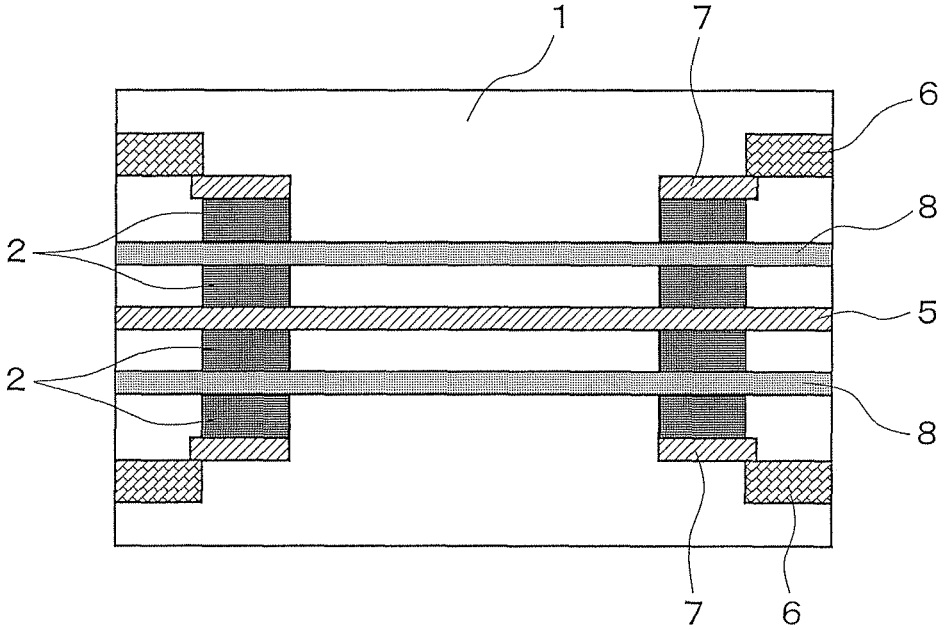
FIG. 5 is a longitudinal sectional view illustrating a second modification.
Figure 6A:
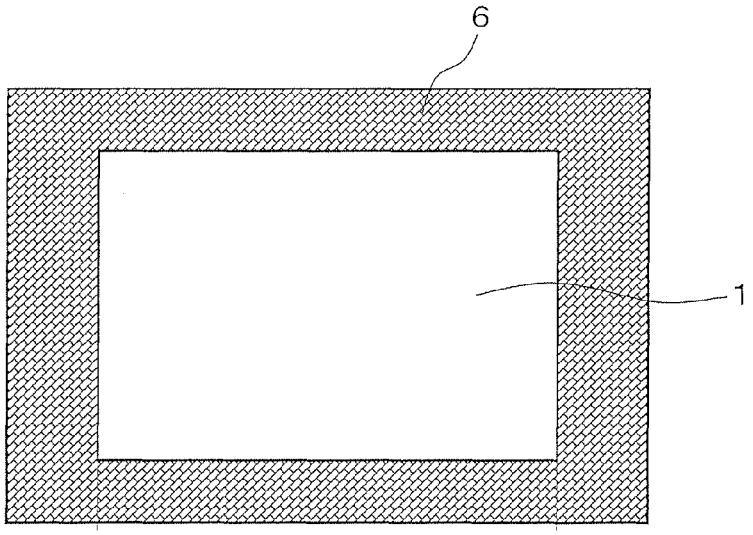
FIG. 6 illustrates a third modification, in which (a) is a plane sectional view, and (b) is a longitudinal sectional view.
Figure 6B:
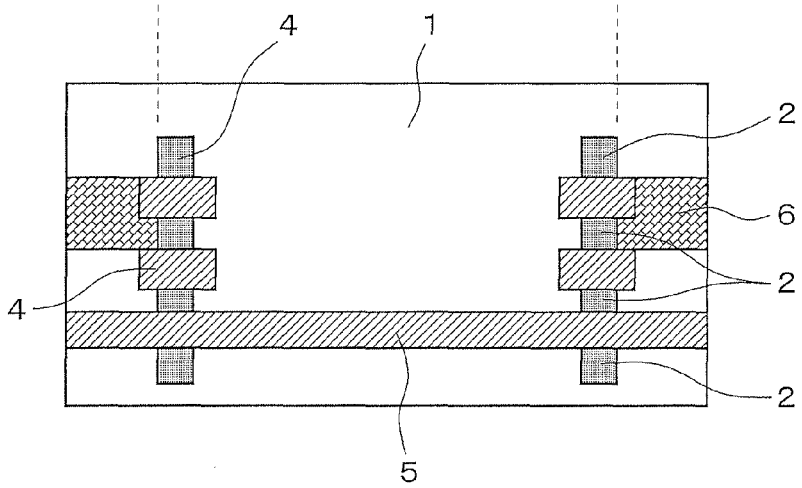

FIG. 1 to FIG. 3 each illustrate a first embodiment of a multilayer inductor according to the present invention, and FIG. 4 to FIG. 6 illustrate first to third modifications, respectively.

As illustrated in FIG. 1 to FIG. 3, this multilayer inductor is formed in a rectangular parallelepiped shape, in which a plurality of electrically insulating magnetic layers 1 and conductive patterns 2 are laminated, and each of the conductive patterns 2 is connected in sequence in a lamination direction, so that a spirally circulating coil 2 is formed inside a magnetic body configured by the magnetic layers 1, and both ends of the coil 2 are drawn out to be connected to external electrodes 3. The external electrodes 3 are connected to a land part of a circuit board (not shown), so that the multilayer inductor is surface-mounted.

Herein, between the conductive patterns 2 adjacent in the lamination direction, an electrically insulating nonmagnetic pattern 4 having a shape corresponding to the shape of each of the conductive patterns 2 are disposed. Furthermore, at an intermediate position in the lamination direction, an electrically insulating nonmagnetic layer 5 that becomes a magnetic gap is disposed over a whole surface by one layer in place of the nonmagnetic pattern 4.

In the multilayer inductor according to this embodiment and multilayer inductors according to first to third modifications, in the axial view of each coil 2, each of magnetized permanent magnet layers 6 is disposed over the whole surface between the outer peripheral edge of this multilayer inductor (namely outer peripheral edge of each magnetic layer 1) and the outer peripheral edge of the coil 2 so as to emit a magnetic flux whose direction is opposite to the direction of a magnetic flux excited by the above coil 2.

That is, in the multilayer inductor of this embodiment, as illustrated in FIG. 3, the annular permanent magnet layers 6 are disposed adjacent to the upper and lower conductive patterns 2 located at the both ends of the lamination direction. Additionally, the permanent magnet layers 6 are formed such that the inner dimension is the same as the outer dimension of the conductive patterns 2 so as not to overlap the permanent magnet layers 6 with the coil 2 in the above axial view.

In order to manufacture the multilayer inductor 1 having the above configuration, as illustrated in FIG. 2, FIG. 3A, and FIG. 3B, Ni—Zn based ferrite material paste of an electrically insulating material is first printed by a screen printing method or the like, so that a magnetic layer 1 is formed.

Then, low-temperature sintered magnet material paste obtained by adding $Bi_2O_3$ and $SiO_2$ to Ba ferrite powder or Sr ferrite powder is printed on this magnetic layers 1, so that a permanent magnet layers 6 is formed, and a magnetic layer 1 is printed at a part except this permanent magnet layer 6. FIG. 2 illustrates a case where four multilayer inductors are manufactured on one plane at the same time.

Then, a conductive pattern 2 is printed on a layer formed with this permanent magnet layers 6. Similarly, after a magnetic layer 1 is printed at a part except the conductive pattern 2, an electrically insulating Zn ferrite material is printed on the conductive pattern 2 so as to have a shape corresponding to the shape of the conductive pattern 2, so that a nonmagnetic pattern 4 is formed, and a magnetic layer 2 is formed at a part except the nonmagnetic pattern 4.

Thus, as illustrated in FIG. 3 (*b*), conductive patterns 2 and nonmagnetic pattern 4 are alternately laminated in magnetic layers 1, so that permanent magnet layers 6 are disposed on the both ends in the lamination direction. Additionally, at the intermediate position in the lamination direction, electrically insulating Zn ferrite material paste which is the same as the nonmagnetic pattern 4 is printed over the whole surface, so that a nonmagnetic layer 5 is formed. With this, upper and lower conductive body patterns 2 are electrically connected by utilizing a via hole or the like.

Next, the obtained laminated body is collectively burned at a temperature of 940° C. or less, more specifically, at about 900° C. to be integrated, and thereafter the permanent magnet layers 6 are magnetized so as to emit a magnetic flux whose direction is opposite to the direction of the magnetic flux excited by the coil 2, so that it is possible to manufacture the multilayer inductor illustrated in FIG. 1. In a case illustrated in FIG. 2, four laminated bodies, each of which configures a multilayer inductor, are cut one by one, and thereafter each laminated body is sintered.

Additionally, FIG. 4 illustrates the first modification of this embodiment, and this multilayer inductor is different from the multilayer inductor illustrated in FIG. 1 to FIG. 3, in that a nonmagnetic pattern 7 made of a Zn ferrite material which is similar to each nonmagnetic pattern 4 formed between the conductive patterns 2 is formed between each permanent magnet layer 6 and each conductive pattern 2 in the lamination direction. As illustrated in FIG. 4, in a case where the inner dimension of the permanent magnet layer 6 is the same as the outer dimension of the conductive patterns 2, or in a case where a clearance is formed between the permanent magnet layer 6 and the conductive patterns 2 in the above axial view, the nonmagnetic pattern 7 is formed to have such dimension that the clearance is blocked.

Furthermore, FIG. 5 illustrates the second modification of this embodiment. In this multilayer inductor, each of magnetic layers 8 having magnetic permeability of ¼ or less of the magnetic permeability of the magnetic body is disposed over the whole surface between the conductive patterns 2 in place of the nonmagnetic patterns 4 disposed between the conductive patterns 2 and used as insulating layers in the first embodiment.

FIG. 6 illustrates a third modification of this embodiment.

In this multilayer inductor, a permanent magnet layer 6 is disposed over two layers of the whole surfaces of the outer peripheral edge of the multilayer inductor (namely, outer peripheral edge of each magnetic layer 1) and the outer peripheral edge of the coil 2. Herein, the permanent magnet layer 6 is disposed at a layer formed with the nonmagnetic pattern 4, and at a layer formed with the conductive pattern 2 located under, and adjacent to, the nonmagnetic pattern 4.

Then, the permanent magnet layer 6 is formed such that the inner peripheral edge of the permanent magnet layer 6 is in contact with the outer peripheral edge of the nonmagnetic pattern 4 at the layer formed with the nonmagnetic pattern 4, and the inner peripheral edge of the permanent magnet layer 6 is in contact with the outer peripheral edge of the conductive pattern 2 at the layer formed with the conductive pattern 2.

Second Embodiment

Figure 7A:
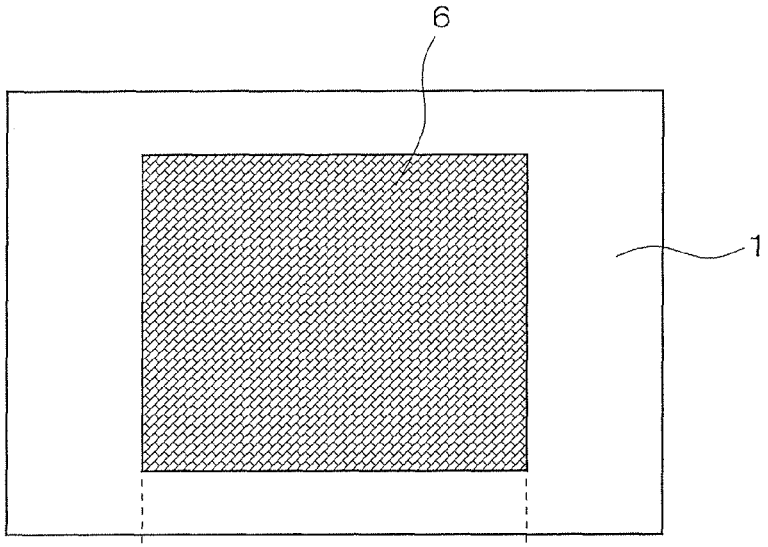
FIG. 7 illustrates a second embodiment of a multilayer inductor of the present invention, in which (a) is a plane sectional view, and (b) is a longitudinal sectional view.
Figure 7B:
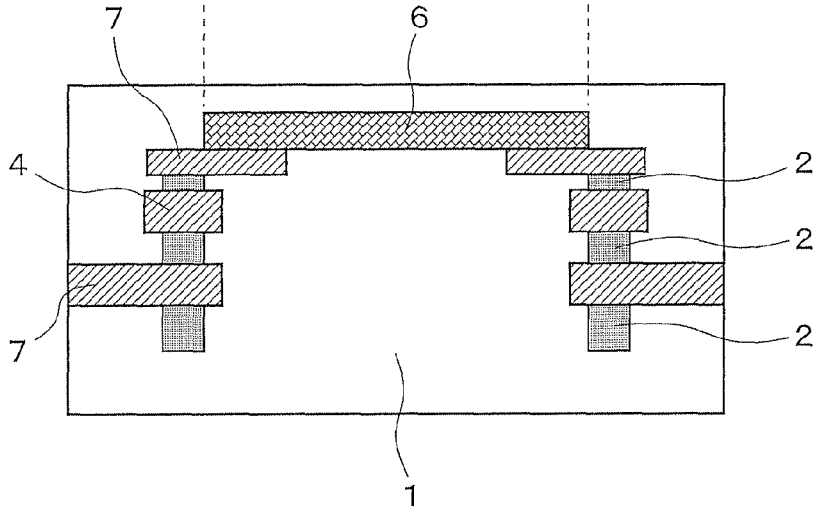
Figure 8A:
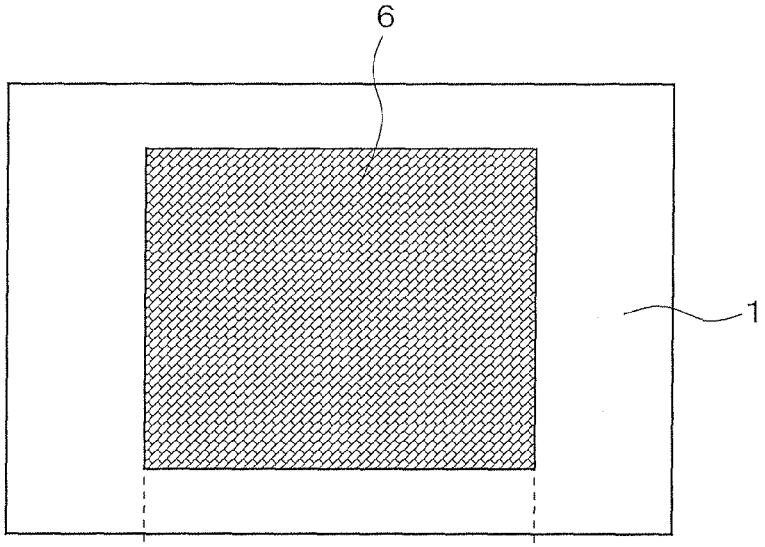
FIG. 8 illustrates a first modification of the second embodiment, in which (a) is a plane sectional view, and (b) is a longitudinal sectional view.
Figure 8B:
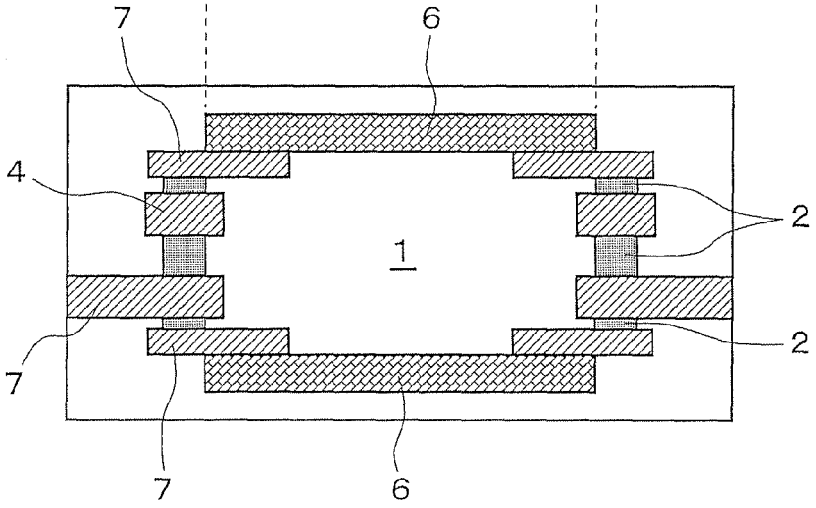
Figure 9A:
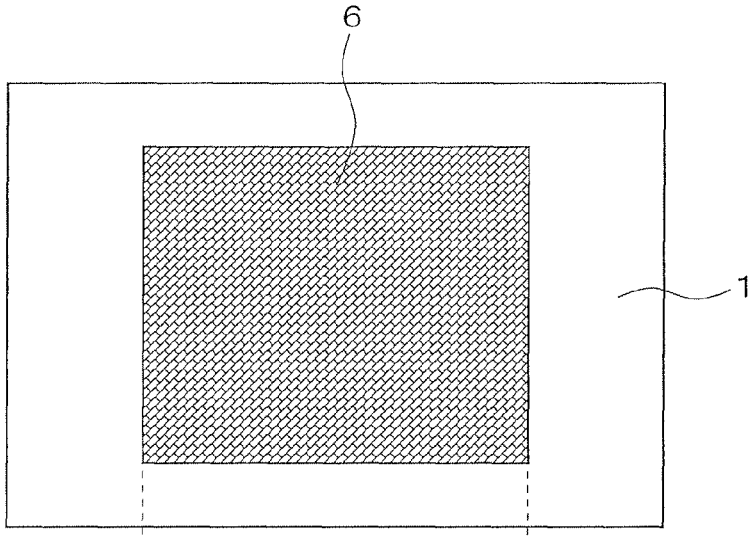
FIG. 9 illustrates a second modification of the second embodiment, in which (a) is a plane sectional view, and (b) is a longitudinal sectional view.
Figure 9B:
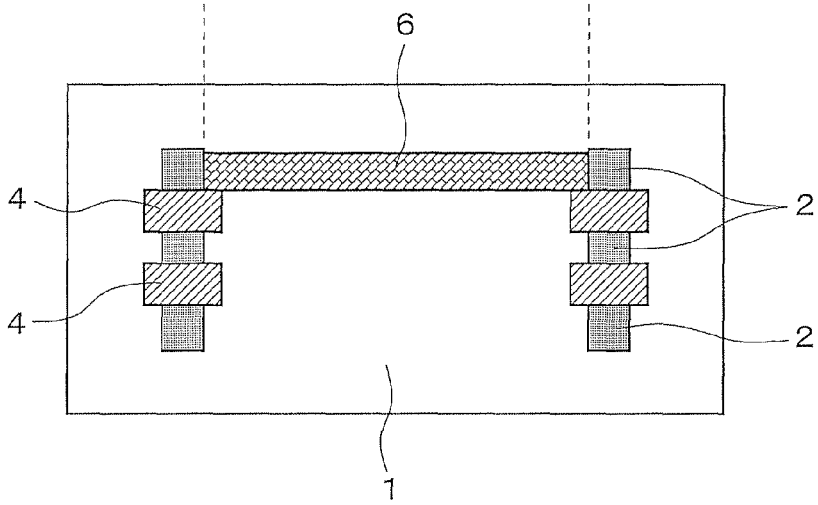
Figure 10A:
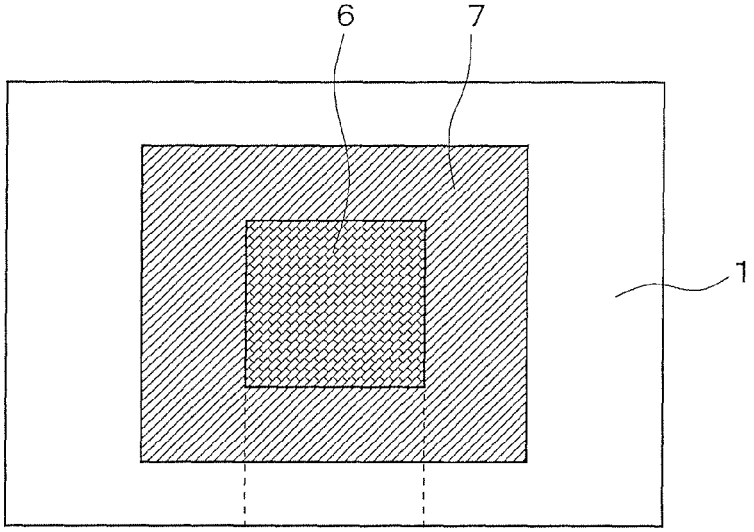
FIG. 10 illustrates a third modification of the second embodiment, in which (a) is a plane sectional view, and (b) is a longitudinal sectional view.
Figure 10B:
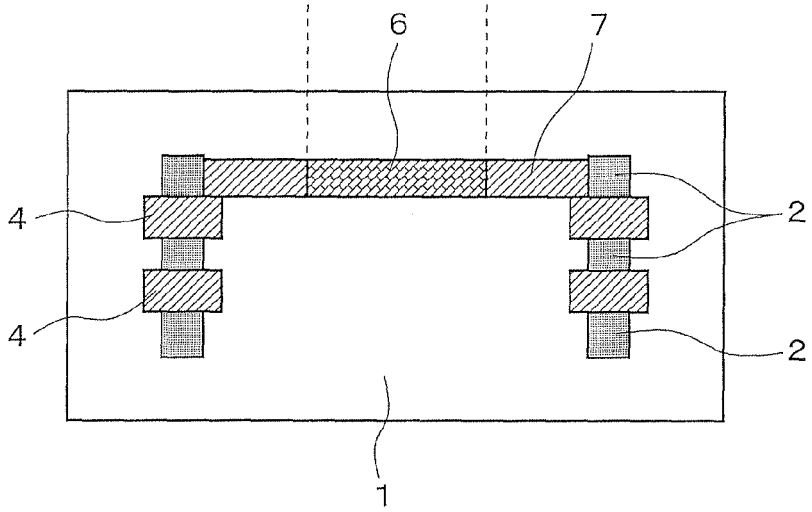

FIG. 7 illustrates a second embodiment of a multilayer inductor according to the present invention, and FIG. 8 to FIG. 10 illustrate first to third modifications of the second embodiment, respectively. Hereinafter, the same components as the components illustrated in FIG. 1 to FIG. 6 are denoted by the same reference numerals, and the description thereof is simplified.

In each of these multilayer inductors, in axial view of a coil 2, a permanent magnet layer 6 magnetized so as to emit a magnetic flux whose direction is opposite to the direction of a magnetic flux excited by the coil 2 is disposed over the whole surface of the inside of the coil 2.

That is, in the multilayer inductor of the second embodiment, as illustrated in FIG. 7, an annular nonmagnetic pattern 7 made of a Zn ferrite material similar to the nonmagnetic pattern 4 formed between the conductive patterns 2 is formed at a layer above a conductive pattern 2 located at an uppermost layer in the figure in a lamination direction so as to extend to the inside of the coil 2, and a quadrangular permanent magnet layer 6 is disposed at an upper layer of this nonmagnetic pattern 7. Herein, the permanent magnet layer 6 is formed such that the outer dimension of the permanent magnet layer 6 is the same as the inner dimension of the conductive pattern 2 so as not to overlap the permanent magnet layer 6 with the coil 2 in the above axial view.

FIG. 8 illustrates the first modification of the multilayer inductor having the above configuration. In this multilayer inductor, a similar annular nonmagnetic pattern 7 is further formed at a layer on the lower side of a conductive pattern 2 located at a lowermost layer in the figure of the drawing in the lamination direction so as to extend to the inside of the coil 2, and a quadrangular permanent magnet layer 6 is further disposed at a lower layer of this nonmagnetic pattern 7, in addition to the above permanent magnet layer 6. This permanent magnet layer 6 is also formed such that the outer dimension of the permanent magnet layer 6 is the same as the inner dimension of the conductive pattern 2 so as not to overlap the permanent magnet layer 6 with the coil 2 in the above axial view.

Next, FIG. 9 illustrates the second modification. In this multilayer inductor, a quadrangular permanent magnet layer 6 is disposed inside a conductive pattern 2 located at an uppermost layer in the figure of the drawing in the lamination direction. This permanent magnet layer 6 is formed at the same layer as the above conductive pattern 2, and is formed such that the outer dimension of the permanent magnet layer 6 is the same as the inner dimension of the conductive pattern 2 so as not to overlap the permanent magnet layer 6 with the coil 2 in the above axial view, and so as not to form a clearance.

Additionally, in the multilayer inductor according to the third modification illustrated in FIG. 10, the outer dimension of the permanent magnet layer 6 illustrated in FIG. 9 is formed in a quadrangle whose size is smaller than the inner dimension of the conductive pattern 2, and, an annular nonmagnetic pattern 7 which blocks a space between the conductive pattern 2 and the permanent magnet layer 6 is formed between the conductive pattern 2 and the permanent magnet layer 6 in the axial view of the coil 2.

Figure 15:
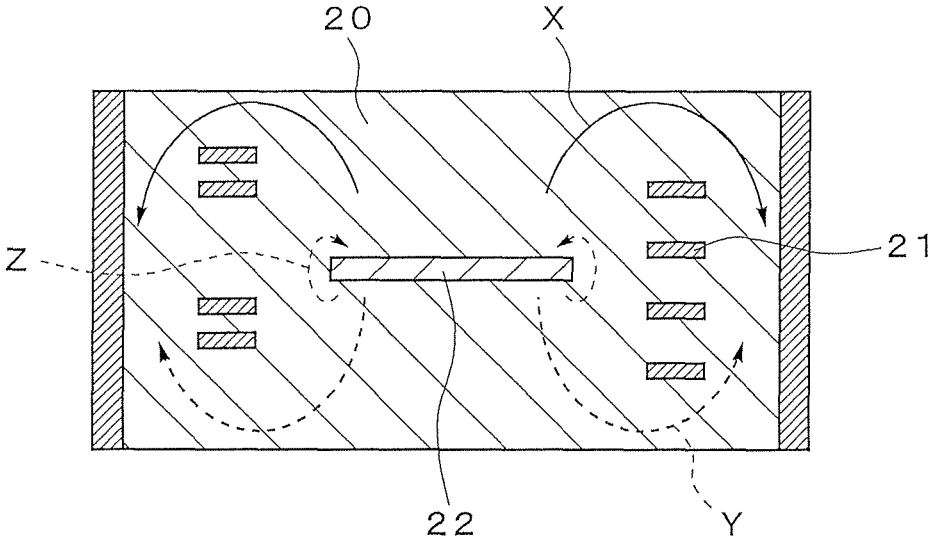
FIG. 15 is a longitudinal sectional view illustrating a conventional multilayer inductor including a magnet.

According to the multilayer inductors shown and described in the first and second embodiments and the modifications of these, the permanent magnet layer 6 is disposed so as to block the outside of the coil 2 or the inside of the coil 2, in axial view, and therefore a leakage magnetic flux Z which does not work as a bias magnetic flux Y and has an opposite direction, like a permanent magnet illustrated in FIG. 15, is not generated. As a result, the permanent magnet layer 6 can significantly improve DC superposition characteristics. In other words, a low-loss material relatively easily saturated can be used as the magnetic body (magnetic layer) 1, and it is possible to achieve the improvement of converter conversion efficiency.

Furthermore, a Ni—Zn ferrite based material is used as the magnetic layers 1, a Zn ferrite based material is used as each of the nonmagnetic patterns 4 and 7, and a low-temperature sintered magnet material obtained by adding $Bi_2O_3$ and $SiO_2$ to Ba ferrite powder or Sr ferrite powder is used as the permanent magnet layer 6, and therefore collective burning is performed at a temperature of about 900° C. at the timing of manufacturing, and thereafter the permanent magnet layer 6 is magnetized, so that it is possible to easily manufacture the multilayer inductor.

Example

In order to verify the effects of the multilayer inductors according to the present invention, the DC superposition characteristics of the multilayer inductors of the present invention, and the DC superposition characteristics of multilayer inductors of comparative examples were obtained to be compared by simulation.

In both the multilayer inductors of the present invention and the multilayer inductors of the comparative examples, chip size was 2.5×2.0×1.0 mm, the number of turns of the internal conductor was 5 turns, a film thickness of the internal conductor was 120 μm, and the thickness of an insulating layer between the internal conductors was 15 μm.

Figure 11:
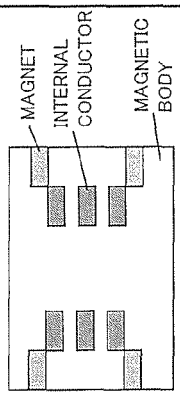
FIG. 11 is a diagram illustrating the result of an example, in which the DC superposition characteristics of the multilayer inductors shown in the first embodiment are compared with the DC superposition characteristics of a multilayer inductor of a comparative example.
Figure 11:
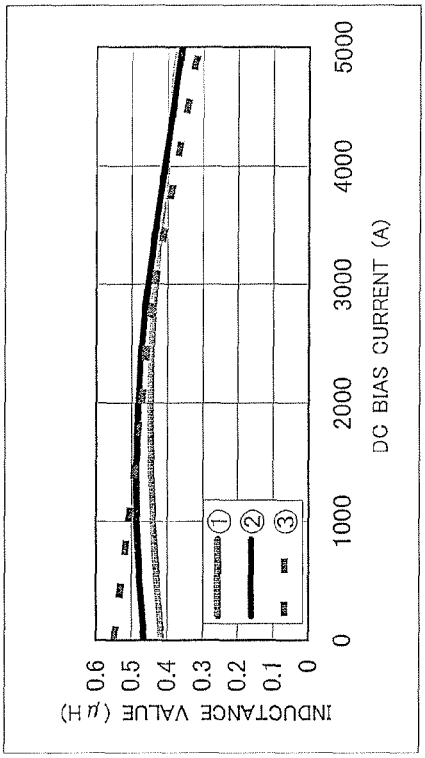
Figure 11:
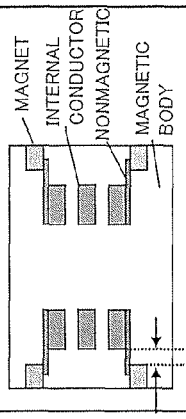
Figure 11:
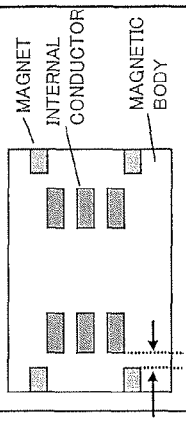

First, FIG. 11 illustrates a case where the DC superposition characteristics of multilayer inductors (1) and (2) having the configurations shown in the first embodiment and the first modification are compared with the DC superposition characteristics of a multilayer inductor (3) of a comparative example formed with a clearance of 50 μm between a permanent magnet layer and an internal conductor. As is clear from FIG. 11, the DC superposition characteristics of the multilayer inductor (1), in which the permanent magnet layer and the internal conductor are disposed so as to be in contact with each other in axial view, is more excellent than the DC superposition characteristics of the multilayer inductor (3) of the above comparative example.

Additionally, also in a case where a clearance is formed between the permanent magnet layer and the internal conductor, the multilayer inductor (2) which blocks the clearance by the nonmagnetic pattern can obtain DC superposition characteristics equivalent to the DC superposition characteristics of the above multilayer inductor (1).

Figure 12:
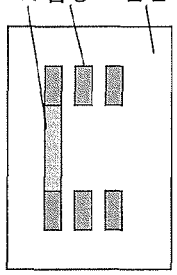
FIG. 12 is a diagram illustrating the result of an example, in which the DC superposition characteristics of the multilayer inductors shown in the second embodiment are compared with the DC superposition characteristics of a multilayer inductor of a comparative example.
Figure 12:
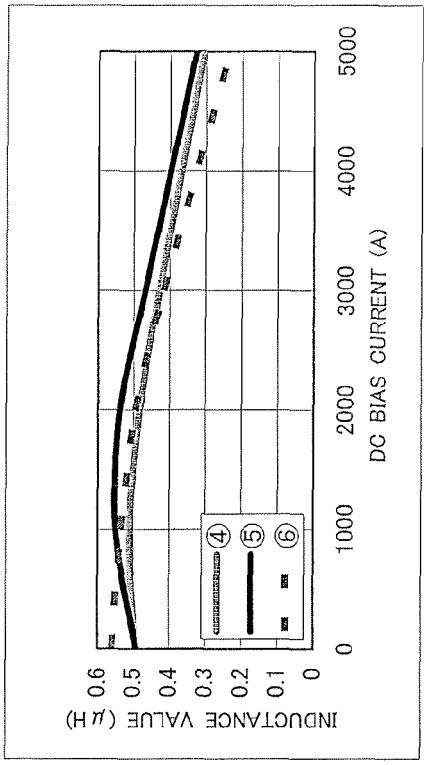
Figure 12:
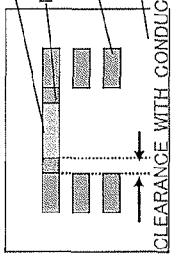
Figure 12:
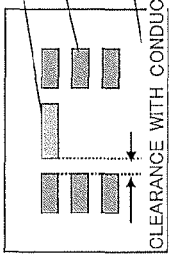

FIG. 12 illustrates a case where the DC superposition characteristics of multilayer inductors (4) and (5) having the configurations shown in the second modification and the third modification of the second embodiment are compared with the DC superposition characteristics of a multilayer inductor (6) of a comparative example formed with a clearance of 50 μm between an internal conductor and a permanent magnet layer disposed inside the internal conductor. Also in the result of the simulation of the DC superposition characteristics illustrated in FIG. 12, the DC superposition characteristics of the multilayer inductors (4) and (5) according to the present invention are more excellent than the DC superposition characteristics of the multilayer inductor (6) of the comparative example.

Figure 13:
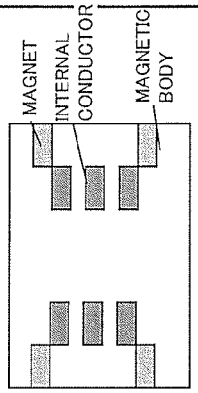
FIG. 13 is a diagram illustrating the result of an example, in which the DC superposition characteristics of the multilayer inductor shown in the first embodiment are compared with the DC superposition characteristics of a multilayer inductor of a comparative example, which is obtained by overlapping a permanent magnet and an internal conductor.
Figure 13:
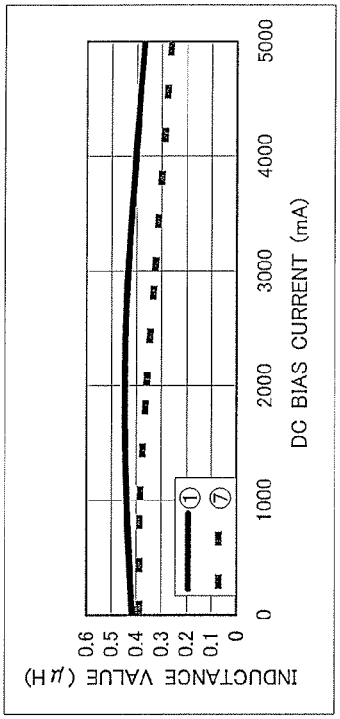
Figure 13:
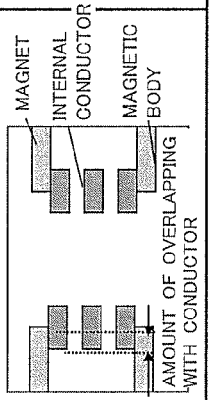

FIG. 13 illustrates a case where the DC superposition characteristics of the above multilayer inductor (1) was compared with the DC superposition characteristics of a multilayer inductor (7) of a comparative example, in which a permanent magnet layer and an internal conductor are overlapped with each other by 150 μm in the axial view of a coil. From this figure of the drawing, it is found that the DC superposition characteristics of the multilayer inductor (7) of the comparative example, in which the permanent magnet layer and the internal conductor are overlapped with each other, remarkably deteriorates compared to the DC superposition characteristics of the multilayer inductor (1) according to the present invention.

Figure 14:
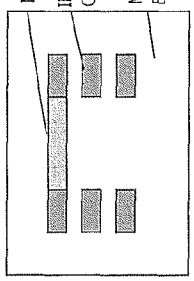
FIG. 14 is a diagram illustrating the result of an example, in which the DC superposition characteristics of the multilayer inductor shown in the second embodiment are compared with the DC superposition characteristics of a multilayer inductor of a comparative example, which is obtained by overlapping a permanent magnet and an internal conductor.
Figure 14:
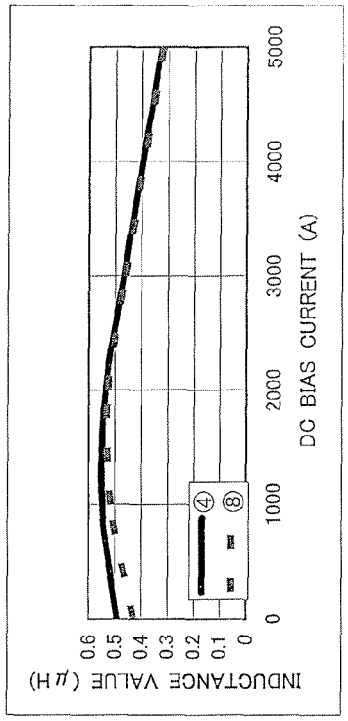
Figure 14:
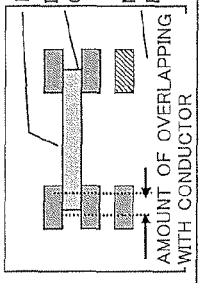

FIG. 14 illustrates a case where the DC superposition characteristics of the above multilayer inductor (4) was compared with the DC superposition characteristics of a multilayer inductor (8) of a comparative example, in which a permanent magnet layer disposed in an internal conductor, and the internal conductor are overlapped with each other by 150 μm in the axial view of a coil. From this figure, it is found that an initial value of the multilayer inductor (8) of the comparative example, in which the permanent magnet layer and the internal conductor are overlapped with each other, particularly largely lowers compared to an initial value of the multilayer inductor (4) according to the present invention. Accordingly, it is found that a structure in which the permanent magnet layer overlaps with the internal conductor in the above axial view is not preferable similarly to the result illustrated in FIG. 13.

INDUSTRIAL APPLICABILITY

It is possible to provide a multilayer inductor, in which it is possible to significantly improve DC superposition characteristics by a permanent magnet which emits a bias magnetic flux, and in which it is possible to use a low-loss material as a magnetic body so as to also achieve the improvement of converter conversion efficiency.

REFERENCE SIGNS LIST

1 Magnetic layer
2 Conductive pattern (coil)
3 External electrode
4, 5, 7, 8 Nonmagnetic pattern
6 Permanent magnet layer

The invention claimed is:

1. A multilayer inductor comprising:

a plurality of electrically insulating magnetic layers that are laminated; and conductive patterns that are laminated, each of the conductive patterns being connected in sequence in the lamination direction to form a spirally circulating coil inside the magnetic layers, both ends of the coil being drawn out to an outer peripheral part, wherein an annular permanent magnet layer magnetized so as to emit a magnetic flux whose direction is opposite to a direction of a magnetic flux excited by the coil is disposed between an outer peripheral edge of the multilayer inductor and an outer peripheral edge of the coil so as not to overlap an inner peripheral part of the annular permanent magnet layer with the conductive patterns and so as to block a space between the conductive patterns and the annular permanent magnet layer, in axial view of the coil.

2. A multilayer inductor comprising:

a plurality of electrically insulating magnetic layers that are laminated; and conductive patterns that are laminated, each of the conductive patterns being connected in sequence in the lamination direction to form a spirally circulating coil inside the magnetic layers, both ends of the coil being drawn out to an outer peripheral part, wherein an annular permanent magnet layer magnetized so as to emit a magnetic flux whose direction is opposite to a direction of a magnetic flux excited by the coil is disposed over a whole surface of inside of the coil so as not to overlap an outer peripheral part of the annular permanent magnet layer with the conductive patterns and so as to block a space between the conductive patterns and the annular permanent magnet layer, in axial view of the coil.

3. The multilayer inductor according to claim 1, wherein in the axial view, a clearance is formed between the permanent magnet layer and the conductive patterns, and the clearance is blocked by an annular electrically insulating nonmagnetic pattern interposed between the permanent magnet layer and the conductive patterns.

4. The multilayer inductor according to claim 1, wherein the magnetic layers and the permanent magnet layer, or the magnetic layers, the permanent magnet layer, and an annular electrically insulating nonmagnetic pattern, are each formed of a material which is capable of being collectively burned at a temperature of 940° C. or less.

5. The multilayer inductor according to claim 4, wherein a Ni—Zn ferrite based material is used as the magnetic layers, a Zn ferrite based material is used as the nonmagnetic pattern, and a low-temperature sintered magnet material obtained by adding $Bi_2O_3$ and $SiO_2$ to Ba ferrite powder or Sr ferrite powder is used as the permanent magnet layer.

* * * * *